United States Patent [19]

Yamamoto et al.

[11] Patent Number: 4,579,097

[45] Date of Patent: Apr. 1, 1986

[54] FUEL SUPPLY APPARATUS AND METHOD FOR INTERNAL COMBUSTION ENGINES

[75] Inventors: Tadahiro Yamamoto, Yokosuka; Tadaki Oota, Fujisawa, both of Japan

[73] Assignee: Nissan Motor Company, Limited, Yokohama, Japan

[21] Appl. No.: 619,306

[22] Filed: Jun. 11, 1984

[30] Foreign Application Priority Data

Jul. 18, 1983 [JP] Japan ..... 58-130476
Nov. 8, 1983 [JP] Japan ..... 58-209644

[51] Int. Cl.[4] ..... P02M 7/18

[52] U.S. Cl. ..... 123/438; 123/439; 123/494

[58] Field of Search ..... 123/438, 439, 437, 464, 123/478, 588, 493, 494; 261/105, 106, 390

[56] References Cited

U.S. PATENT DOCUMENTS 2,943,614 7/1960 Bosch et al. ..... 123/494
3,747,577 7/1973 Mauch et al. ..... 123/494
4,050,428 9/1977 Masaki ..... 123/438
4,290,401 9/1981 Pederson ..... 123/437
4,349,877 9/1982 Oyama et al. ..... 123/439
4,369,749 1/1983 Suyi ..... 123/439
4,442,818 4/1984 Kashiwaya et al. ..... 123/438

*Primary Examiner*—Raymond A. Nelli
*Attorney, Agent, or Firm*—Schwartz, Jeffery, Schwaab, Mack, Blumenthal & Evans

[57] ABSTRACT

A first temperature sensor senses the temperature of intake air supplied to an internal combustion engine before the intake air is mixed with fuel supplied thereto. A second temperature sensor senses the temperature of the mixture of the intake air and fuel within the intake air passage. A control unit controls the fuel injection quantity in accordance with the difference between the sensed temperatures, thereby causing the actual air-fuel ratio to coincide with a desired air-fuel ratio. The desired air-fuel ratio is adjusted in accordance with the throttling effect of a throttle valve in the intake air passage and with engine speed.

23 Claims, 5 Drawing Figures

FUEL SUPPLY APPARATUS AND METHOD FOR INTERNAL COMBUSTION ENGINES

BACKGROUND OF THE INVENTION

This invention relates to a fuel supply apparatus and method for internal combustion engines such as gasoline engines and more particularly to a fuel supply apparatus which adjusts an air-fuel ratio in accordance with decreases in the temperature of intake air to the engine due to heat of vaporization of fuel.

For example, a fixed venturi carburetor used extensively as a fuel supply apparatus for a gasoline engine is designed to control intake air flow by means of a butterfly throttle valve provided within an intake air passage to the engine and associated with an accelerator pedal, to measure the quantity of intake air in terms of the vacuum pressure in the fixed venturi, and to adjust the difference between pressures upstream and downstream of a fuel jet which meters fuel in accordance with the vacuum pressure differential in order to approach a desired air-fuel ratio. An SU carburetor typical of variable-venturi carburetors controls intake air flow by means of a butterfly throttle valve, measures the controlled intake air flow in terms of the equilibrium position of a suction piston which slides so as to hold the velocity of intake air in the variable venturi constant, and adjusts the flow cross-section of a fuel nozzle in accordance with the equilibrium position, thereby metering fuel.

A recently extensively used electronically controlled fuel injection apparatus measures intake air flow by means of an air flowmeter or a pressure sensor, calculates a required quantity of intake air in accordance with the measured quantity of intake air and controls fuel flow in accordance with the time interval of opening of a fuel injector.

In summary, in each of the above-mentioned prior art fuel supply apparatus, the actual air-fuel ratio of the air-fuel mixture is not directly measured, nor is the actual air-fuel ratio of air-fuel mixture derived after the corresponding measurements of intake air flow and fuel flow are fed back. Thus, the air-fuel ratio is liable to be influenced by various factors such as the accuracy of machining of the needle valve, so that it is difficult to realize air-fuel ratio control with the high precision necessary for exhaust emission control and fuel economy.

Recently, an air-fuel ratio control system has been put to practice in internal combustion engines using a three-way catalyst which senses the quantity of oxygen remaining in the exhaust emissions to recognize the magnitude of the air-fuel ratio, thereby controlling fuel flow in the carburetor by feedback. This method serves only to hold the air-fuel ratio at a constant, stoichiometric value and determines the air-fuel ratio solely on the basis of the exhaust emissions, so that this system cannot be used in conjunction with a secondary air introduction device (See "SERVICE WEEKLY No. 472" (page 56) published October 1982 by NISSAN MOTOR COMPANY, LTD.)

SUMMARY OF THE INVENTION

It is therefore an object of this invention to provide a fuel supply apparatus which directly determines the air-fuel ratio of an actual air-fuel mixture from a known relationship between decreases in the temperature of intake air due to heat of vaporization of fuel and the air-fuel ratio and controls the fuel flow on the basis of the determined air-fuel ratio by feedback thereby highly precisely controlling the air-fuel ratio.

This invention provides a fuel supply apparatus which includes means for controlling an intake air flow by changing the cross-section of an intake air passage in accordance with the manual operation of an accelerator pedal, means for introducing fuel into the air within the intake air passage so as to induce vaporization of the fuel, means for sensing the temperature difference between the intake air before being supplied with fuel and the intake air after vaporization of the fuel and means for controlling the fuel supplying means such that the sensed temperature difference coincides with a desired temperature difference, thereby achieving a highly precise air-fuel ratio control.

It is known that when air is mixed with fuel such as gasoline, generally speaking, the temperature of the air-fuel mixture is lowered due to the heat of vaporization of the fuel. Assume that 100% of the fuel has vaporized. Unless external heat is imparted to the intake air, the decrease $\Delta T$ in temperature of the intake air due to the heat of vaporization and the air-fuel ratio $G_A/G_F$ ($G_A$: air quantity flow and $G_F$: fuel quantity flow) have a known relationship, i.e. since the heat capacity after fuel vaporization is negligible, if the potential heat of fuel vaporization is designated H and the specific heat of intake air is labelled $C_p$, the relationship $G_A/G_F = H/C_p \cdot 1/\Delta T$ holds. If H and $C_p$ are regarded as substantially constant, the air-fuel ratio $G_A/G_F$ can be derived from temperature decrease $\Delta T$ regardless of the rate of intake air flow. This invention performs air-fuel control on the basis of this principle. That is, this invention controls fuel flow using feedback based on the temperature decrease $\Delta T$ corresponding to a desired air-fuel ratio.

In addition, the apparatus according to this invention can adjust the desired temperature difference in accordance with the throttling of the intake air quantity controlling means and engine speed in order to compensate for decreases in the percentage of fuel vaporization under low-engine speed and high engine load conditions, so that great deviation from the desired air-fuel ratio is prevented, thereby maintaining in practice satisfactory air-fuel ratio accuracy even under engine operating conditions in which the percentage of fuel vaporization is relatively low.

The above and other objects, features and advantages of this invention will made be apparent in the following description of several preferred embodiments thereof, taken in conjunction with the accompanying drawings.

DETAILED DESCRIPTION OF THE PREFERRED EMBODIMENTS

Figure 1:
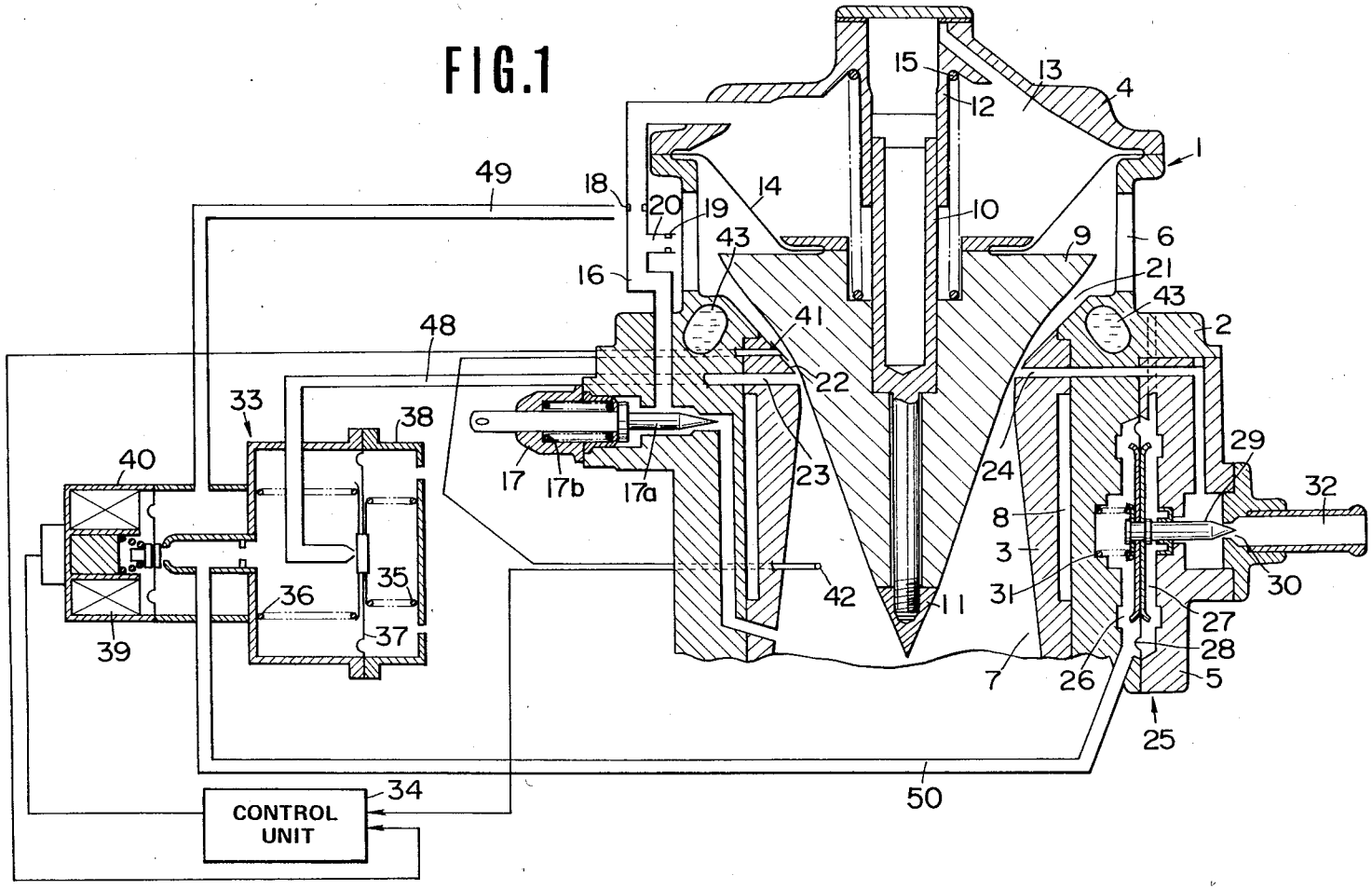
FIG. 1 is a cross-sectional view of a first preferred embodiment of a fuel supply apparatus according to this invention.

Referring to FIG. 1, there is shown a first preferred embodiment of a fuel supply apparatus according to this invention. This embodiment uses a nozzle to control the quantity of intake air to the engine. Thus, the intake air is boosted to sonic or at least subsonic speeds in order to atomize the fuel, thereby ensuring substantially complete vaporization of the fuel, which is the basic assumption of the principle of measuring the air-fuel ratio.

In FIG. 1, a throttle body 1 disposed between the intake intake manifold (not shown) and the air cleaner (not shown) includes a substantially cylindrical body 2, a hollow insert 3 press-fitted into body 2 and made of a thermal insulating synthetic resin, a vacuum chamber cover 4 covering the upper end of body 2 and a diaphragm housing 5 fixed to the side of body 2. Thermal insulating insert 3 is provided for preventing external heat from adversely affecting the temperature measurement by thermocouples which will be mentioned later. It also has an air inlet 6 in its upper half and a mixture exit 7 opening downward and leading to the engine (not shown). An annular space 8 is formed between insert 3 and body 2 for the purpose of further thermal insulation of insert 3.

A substantially conical throttle valve 9 is accommodated within body 2. A support shaft 10 extends axially through throttle 9 and is fixed by threads 11 to throttle 9. The upper end of support shaft 10 is slidably received in a guide sleeve 12 of cover 4. Throttle 9 is connected to a diaphragm 14 defining in part a vacuum chamber 13 and is normally biased downward by a coil spring 15 seated between upper guide sleeve 12 and throttle 9. The axial position of throttle 9 in guide sleeve 12 is controlled by the vacuum pressure within vacuum chamber 13.

In more detail, the exit 7 for mixture gas on which the engine vacuum pressure is exerted communicates via a vacuum pressure passage tube 16 with vacuum pressure chamber 13. Passage tube 16 is equipped with a vacuum pressure control valve 17 which includes a needle valve 17*a* and a return spring 17*b* normally biasing the needle valve so as to close passage tube 16. Needle valve 17*a* is actuated indirectly by the accelerator pedal (not shown) so as to control the cross section of the vacuum pressure passage tube 16. In order to relieve the vacuum pressure, an atmospheric passage tube 20 is connected via orifices 18, 19 to passage tube 16.

Conical throttle 9, which is made of a fully thermal-insulating synthetic resin, cooperates with insert 3 to define a variable annular sonic nozzle 21. This nozzle 21 is designed such that the cross-section of its narrowest throat 22 changes in accordance with the vertical movement of throttle 9. A vacuum pressure draw port 23 is formed slightly downstream of throat 22. A fuel supply port 24 is provided at substantially the position of throat 22.

A diaphragm valve 25 which constitutes a fuel supply mechanism includes a diaphragm 28 which partitions the inside space of the diaphragm valve into a variable vacuum pressure chamber 26 and a constant atmospheric pressure chamber 27, a valve body 29 fixed to diaphragm 28 and a coil spring 31 which biases diaphragm 28 so as to cause valve body 29 to close a valve port 30. Thus, the flow of fuel drawn out of fuel supply port 24 via valve port 30 from a fuel inlet 32 is controlled by the vacuum pressure introduced into vacuum pressure chamber 26. The vacuum pressure controlling diaphragm valve 25 is generated by a control valve 33 on the basis of a signal from a control unit 34. Valve 33 includes a pressure regulating valve 38 which regulates the vacuum pressure introduced via a duct 48 from vacuum pressure draw port 23 by means of a pair of springs 35, 36 and a diaphragm 37 which partitions the interior of valve 33 into two chambers enclosing springs 35, 36, and communicating with the atmosphere and vacuum pressure introduced via duct 48, respectively, thereby producing a constant pressure, and an electromagnetic regulator 40 which includes an electromagnetic valve 39 which opens and closes to mix the constant pressure with atmospheric pressure available via a duct 49 in order to produce a desired vacuum pressure. In more detail, the duty cycle of a drive pulse signal which opens and closes electromagnetic valve 39 at a constant frequency is adjusted to control the vacuum pressure applied to diaphragm valve 25 via a duct 50.

First and second thermocouples 41 and 42 are installed slightly upstream of the throat 22 of variable sonic nozzle 21 and in the vicinity of mixture gas exit 7, respectively, to measure the temperature of air flowing into the sonic nozzle 21 before being mixed with fuel and the temperature of the mixture gas into which fuel has been fully vaporized. First and second thermocouples 41, 42 are connected in series to derive the difference between the temperatures measured by the first and second thermocouples. Control unit 34 compares the measured temperature difference to a desired temperature determined in accordance with a desired air-fuel ratio and controls the duty cycle of electromagnetic valve 39 in accordance with the difference between the measured and desired temperatures.

A warm water passage 43 is formed in the vicinity of a fuel supply port 24 to allow engine coolant to pass therethrough in order to heat the fuel flowing to fuel port 24 for expedition of fuel evaporation.

In operation, in this embodiment of the fuel supply apparatus, control of intake air quantity is performed by conical throttle 9 in place of the prior art butterfly valve. That is, when vacuum control valve 17 is opened in response to the depression of an accelerator (not shown), engine vacuum pressure from mixture gas exit 7 is introduced into vacuum chamber 13 to thereby move conical throttle 9 upward while when valve 17 is closed, the vacuum pressure in vacuum chamber 13 is diluted to move conical throttle valve 9 downward. Vertical movement of conical throttle valve 9 changes the cross-sectional area of the throat 22 of sonic nozzle 21 to control the air flow from air inlet 6 to mixture gas exit 7. When the difference between the pressure at air inlet 6 (substantially equal to the atmospheric pressure) and the pressure at mixture exit 7 (equal to engine intake vacuum pressure) is greater than a predetermined value, air flow at the throat 22 will be sonic. When the accelerator is fully depressed, i.e., vacuum pressure control valve 17 is fully opened, the equilibrium between the action of coil spring 15 and the load on same ensures that vacuum pressure will be higher than a minimum setting (for example −30 mmHg) in order to ensure sufficient air speed at throat 22.

Fuel is drawn from fuel supply port 24 in the vicinity of throat 22 and mixed with the intake air. In this case, the air speed of the intake air at throat 22 is extremely high, as mentioned above, so that fuel is thoroughly atomized and nearly completely vaporized. In this connection, a typical carburetor forms fuel droplets 100–200 μm in diameter whereas the nozzle 21 of the apparatus according to this invention forms fuel droplets about 20 μm in diameter and substantially fully vaporizes the fuel by the time the mixture reaches a point a few centimeters downstream of throat 22. The resulting uptake of the heat of vaporization of the fuel lowers the temperature of the air-fuel mixture, generating a difference between the temperatures sensed by the first and second thermocouples 41 and 42.

In control unit 34, a desired temperature difference corresponding to the desired air-fuel ratio is compared to the difference between the sensed temperatures. If the sensed temperature difference is less than the desired temperature difference, the vacuum pressure produced by vacuum pressure supply valve 33 is intensified to increase the opening of diaphragm valve 25, thereby increasing fuel flow and hence the air-fuel ratio. On the other hand, when the sensed temperature difference is greater than the desired temperature difference, the vacuum pressure produced by vacuum pressure supply valve 33 is diluted to decrease the opening of diaphragm valve 25, thereby decreasing fuel flow and hence the air-fuel ratio. Repetition of this operation causes the actual air-fuel ratio to closely approximate the desired air-fuel ratio.

As is clear from the above, the fuel supply apparatus according to this invention does not control the air-fuel ratio on the basis of measured intake air and fuel quantities, but directly senses the actual air-fuel ratio of the air-fuel mixture and controls the air-fuel ratio by feedback. The apparatus controls the air-fuel ratio with a constant accuracy from the minimum intake air flow rate to the maximum. It also optimizes the air-fuel ratio while the engine is idling or under high loads. The air-fuel ratio can be controlled as a air-fuel mass ratio, so that no corrections are required even at higher elevations.

Figure 2:
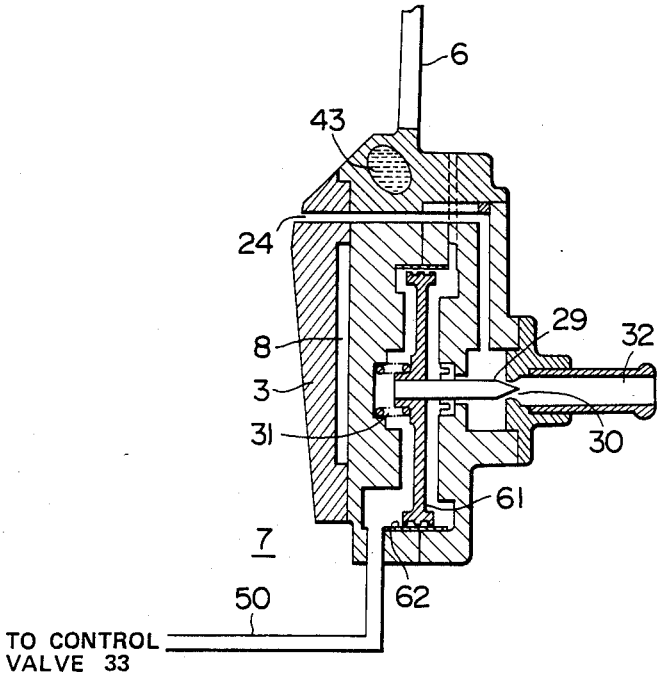
FIG. 2 illustrates the essential portion of a second embodiment of this invention.
Figure 3:
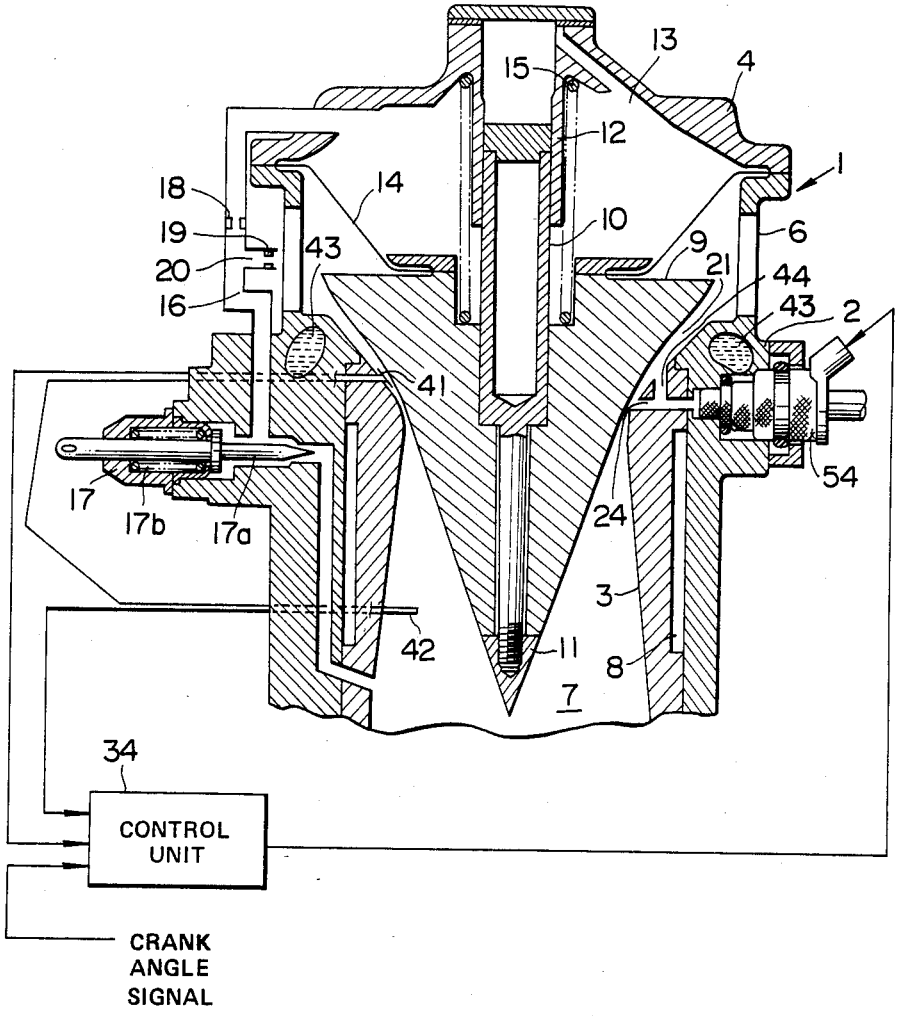
FIG. 3 is a view, similar to FIG. 1, of a third embodiment of this invention.

In the above embodiment, vacuum pressure is controlled by control unit 34 in terms of the duty cycle of a control signal, but it may also be controlled in an analog fashion. Fuel flow is controlled by vacuum pressure supply valve 33 and a diaphragm valve 25, but may alternatively be controlled by a piston mechanism in place of diaphragm 25 or directly by an electromagnetic valve. That is, in a second embodiment of this invention, the essential portion of which is shown in FIG. 2, a piston 61 is employed in place of diaphragm 28 of FIG. 1. In operation of piston 61 is substantially the same as that of diaphragm of FIG. 1. Reference numeral 62 denotes a labyrinth seal. Except for this difference, the first and second embodiments are structurally the same. Also, as shown in a third embodiment of FIG. 3, the opening interval of electromagnetic fuel valve 54 may be controlled such that the measured temperature difference coincides with a desired temperature difference which is adjusted in accordance with the sensed engine speed represented by a crank angle signal. The third embodiment of FIG. 3 does not include a control valve such as shown at 33, a diaphragm valve such as shown at 25, and the related ducts such as shown at 48–50 in FIG. 1.

In the above embodiments, variable throat nozzle 21 is used to expedite vaporization of fuel, but a mechanism which uses a typical butterfly throttle valve may be used instead if fuel vaporization is facilitated, for example by preheating the fuel or by means of a high-pressure fuel injector.

Figure 4:
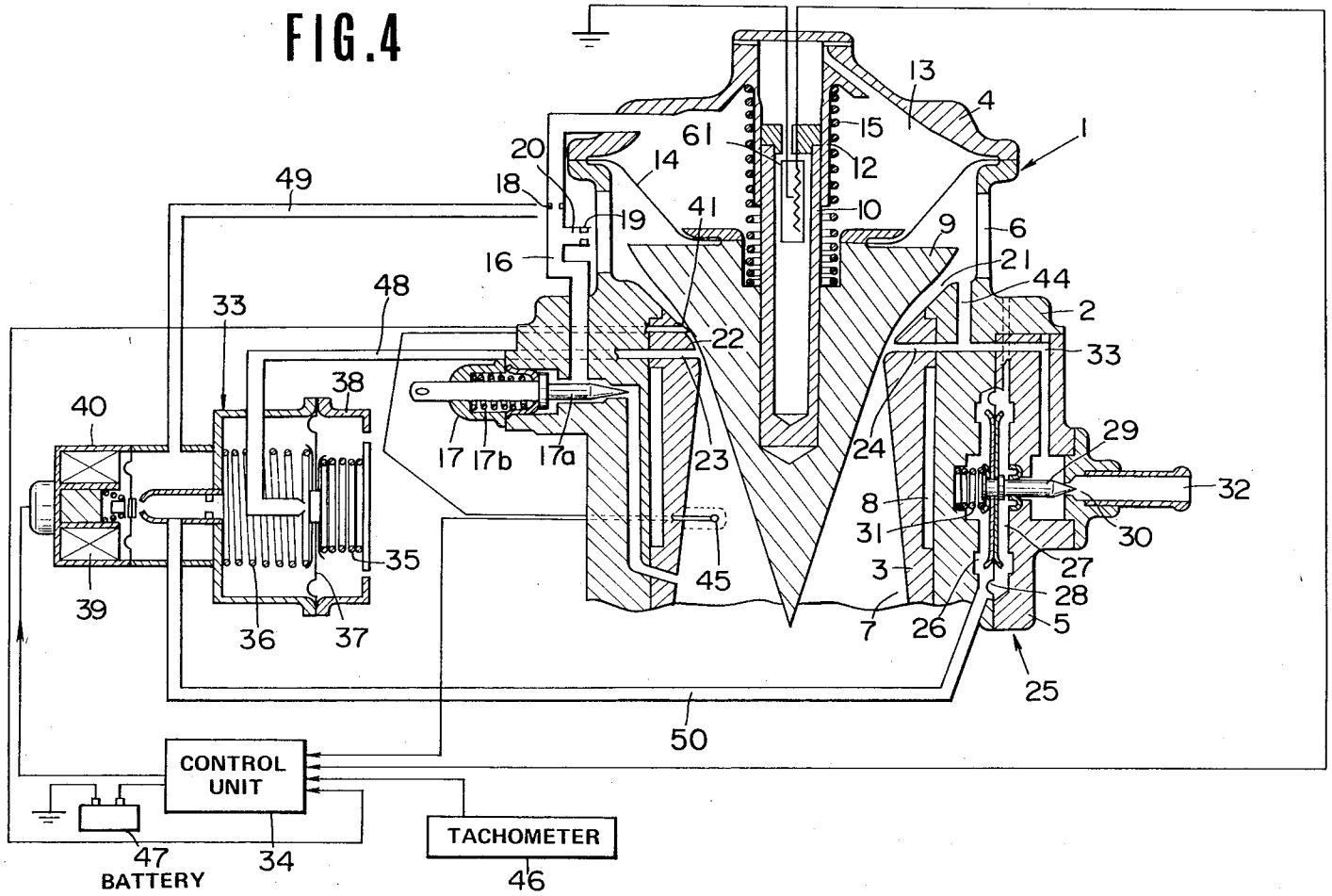
FIG. 4 is a view, similar to FIG. 1, of a fourth embodiment of this invention.

A fourth embodiment of this invention is shown in FIG. 4. Generally, only the structural elements of this embodiment differing from the first embodiments will be described. A potentiometer 61 is provided within guide sleeve 12 to provide a quantitative measurement of the axial position of support shaft 10 and hence the axial position of conical throttle 9. The coolant passage 43 of FIG. 1 is replaced by an auxiliary air passage 44 which communicates between passages 33 and 24 to allow air from the upstream side of nozzle 21 to expedite atomization of fuel flowing from passage 33 to port 24. A tachometer 46, which may be a pulse generator producing pulses synchronously with crankshaft rotation, is connected to control unit 34 to allow adjustment of the desired temperature difference in accordance with the sensed engine speed in conjunction with the position of sonic nozzle 21 represented by the output of potentiometer 12 mentioned above. This is because the percentage of fuel vaporization depends on the position of nozzle 21 and engine speed. The adjustment to the desired temperature difference is empirically determined. Reference numeral 47 denotes a battery.

According to this fourth embodiment, even under low engine load conditions such as during idling where, generally speaking, precise control of air-fuel ratio is difficult, precise control of air-fuel ratio can be achieved. In addition, in the operating range in which fuel vaporization decreases, the desired temperature difference is accordingly adjusted to ensure a constant accuracy of control of air-fuel ratio, thereby suppressing errors in an air-fuel ratio due to rapid acceleration of engine.

Figure 5:
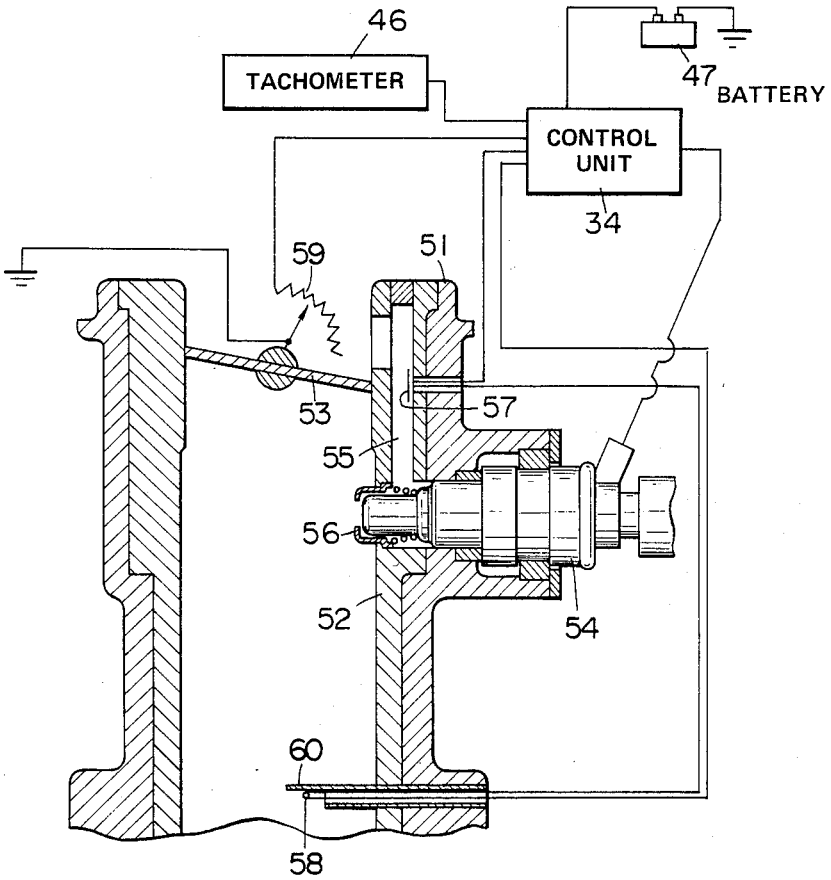
FIG. 5 illustrates a fifth embodiment of this invention.

A fifth embodiment of this invention which uses a butterfly throttle valve for intake air control, is shown in FIG. 5. A throttle body 51 has a hollow cylindrical thermal insulator 52, a butterfly throttle valve 53 associated with an accelerator pedal (not shown), and an electromagnetic fuel injector 54 provided downstream of valve 53. A bypass passage 55 open into the upstream side of butterfly throttle valve 53 and communicates with the injection port 56 of fuel injector 54, so that air flowing downward through bypass passage 55 serves to atomize the injected fuel. The first thermocouple 57 is installed within passage 55, and the second thermocouple 58 is installed downstream of fuel injector 54 and has a cover 60 which prevents deposition of fuel droplets onto thermocouple 58. A potentiometer 59 is fixed to throttle valve 53. In this apparatus employing a conventional butterfly throttle valve, the percentage of fuel atomization under high load on the engine is greatly decreased, but correction or compensation for this is performed as in the preceding embodiments, thereby ensuring in practice satisfactory air-fuel ratio accuracy.

As is clear from the above, the fuel supply apparatus according to this invention directly senses the air-fuel ratio of the air-fuel mixture itself and controls the fuel supply quantity by feedback so that air-fuel ratio can be controlled with a constant accuracy independent of intake air quantity, and that the air-fuel ratio is not affected by machining accuracy. The desired air-fuel ratio can be produced even under engine operating conditions in which the percentage of fuel vaporization tends to be reduced, e.g. under high engine loads.

While this invention has been shown and described in terms of several exemplary embodiments thereof, this invention is not limited to these. Various changes and modifications could be made by those skilled in the art without departing from the scope of this invention.

What is claimed is:

1. A fuel supply apparatus for an internal combustion engine, comprising:

(a) means for changing the cross-sectional area of an intake air passage leading into the engine in accordance with the operation of an accelerator pedal;

(b) means for supplying fuel to the air within said intake air passage at an adjustable rate and causing the fuel to vaporize;

(c) means for measuring the difference between the temperature of the intake air before being supplied with fuel and the temperature of the mixture of the intake air and the vaporized fuel;

(d) means for determining a target temperature difference;

(e) means for sensing an operating condition of the engine;

(f) means for correcting the target temperature difference in accordance to the sensed engine operating condition;

(g) means for comparing the measured target difference with the corrected target temperature difference; and (h) means for adjusting the rate of fuel supply in accordance with the result of the comparison between the temperature differences.

2. A fuel supply apparatus as claimed in claim 1, wherein said means for controlling said fuel supplying means controls the time interval for which said fuel supplying means supplies fuel to the air.

3. A fuel supply apparatus as claimed in claim 1, wherein said temperature difference measuring means includes a first temperature measuring means disposed upstream of a point where fuel is supplied by said fuel supplying means to the intake air for measuring the temperature of the intake air, and a second temperature measuring means disposed downstream of said point for measuring the temperature of the mixture of the intake air and the vaporized fuel, said first and second temperature measuring means being connected so as to output a signal indicative of the measuring temperature difference.

4. A fuel supply apparatus as claimed in claim 3, wherein said means for controlling said fuel supply means includes means for supplying a constant vacuum pressure, means for partially diluting the constant vacuum pressure with air at atmospheric pressure to an extent in accordance with the signal indicative of the measured temperature difference, and a diaphragm means displaced in accordance with the diluted vacuum pressure for controlling the fuel quantity supplied by said fuel supplying means.

5. A fuel supply apparatus as claimed in claim 3, wherein said means for controlling said fuel supply means includes means for supplying a constant vacuum pressure, means for partially diluting the constant vacuum pressure with air at atmospheric pressure to an extent in accordance with the signal indicative of the measured temperature difference, and a piston means displaced in accordance with the diluted vacuum pressure for controlling the fuel quantity supplied by said fuel supplying means.

6. A fuel supply apparatus as claimed in claim 1, wherein said means for changing the cross-sectional area of an intake air passage includes a conical throttle valve movable within said intake air passage and defining a variable venturi throat through which the intake air flows to said engine between said throttle valve and said intake air passage, and means for controlling the cross-section of flow of said venturi throat in accordance with the vacuum pressure downstream of said conical throttle valve.

7. A fuel supply apparatus as claimed in claim 6, wherein said means for controlling the cross-section of flow of said venturi throat includes means including a second diaphragm defining a vacuum chamber and connected to said conical throttle valve, means for introducing the vacuum pressure downstream of said conical throttle valve into said vacuum chamber to displace the second diaphragm and thereby displace the conical throttle valve relative to said intake air passage, and means disposed in said introducing means for controlling the vacuum pressure introduced into said vacuum chamber in accordance with the operation of said accelerator pedal.

8. A fuel supply apparatus as claimed in claim 6, wherein said fuel supplying means includes a fuel supply port exposed to said venturi throat.

9. A fuel supply apparatus as claimed in claim 8, further including a passage provided in the vicinity of the fuel supply port for conducting a heating medium therethrough in order to heat the fuel to expedite vaporization thereof.

10. A fuel supply apparatus as claimed in claim 8, further including a passage connecting the intake air passage upstream of said venturi throat to said fuel supply port for introducing intake air from the upstream side of said venturi throat in order to expedite vaporization of fuel.

11. A fuel supply apparatus as claimed in claim 6, further wherein said means for sensing an operating condition of said engine includes means for sensing the position of said conical venturi throttle valve and means for sensing engine speed and wherein said means for correcting the target temperature difference adjusts the target temperature difference in accordance with the sensed position of said conical venturi throttle valve and the sensed engine speed.

12. A fuel supply apparatus as claimed in claim 11, wherein said means for sensing the position of said conical venturi throttle valve includes a potentiometer associated with said conical venturi throttle valve for outputting a signal indicative of the position of said conical venturi throttle valve.

13. A fuel supply apparatus as claimed in claim 1, wherein said means for changing the cross-sectional area of the intake air passage includes a butterfly throttle valve provided in said intake air passage.

14. A fuel supply apparatus as claimed in claim 13, further wherein said means for sensing an operating condition of said engine includes means for sensing the opening of said butterfly throttle valve and outputting an opening signal indicative thereof, and means for sensing engine speed and outputting a speed signal and wherein said means for correcting the target temperature difference receives said opening signal and said speed signal and adjusts the target temperature difference in accordance with same.

15. A fuel supply apparatus as claimed in claim 13, further including a bypass passage bypassing said butterfly throttle valve and having ends exposed to the upstream and downstream sides of said butterfly throttle valve means, and wherein said fuel supply means includes a fuel injector disposed in the end of said bypass passage downstream of said butterfly throttle valve for injecting fuel into the intake air passage, the end of said bypassing passage downstream of said butterfly throttle valve defining a space around the end of said fuel injector through which fuel is injected into the intake air passage, whereby the flow of intake air through said space into said intake air passage serves to expedite vaporization of fuel.

16. A fuel supply apparatus as claimed in claim 15, wherein said means for measuring the temperature difference includes a first temperature sensor disposed within said bypass passage for sensing the temperature of the intake air flow therethrough and a second temperature sensor disposed downstream of said fuel injector within said intake air passage for sensing the temperature of the mixture of the intake air and the fuel supplied thereto, said first and second temperature sensors being connected so as to output a signal indicative of the difference between the temperatures sensed by said first and second temperature sensors.

17. A fuel supply apparatus as claimed in claim 16, wherein said second temperature sensor has a cover preventing deposition of fuel from the mixture of intake air and fuel.

18. A fuel supply apparatus as claimed in claim 3, further including an inside thermal insulator provided within said intake air passage for preventing adverse external thermal influences on the measurement of temperature by said first and second temperature sensors.

19. A fuel supply apparatus as claimed in claim 16, further including an inside thermal insulator provided within said intake air passage for preventing adverse external thermal influences on the measurement of temperature by said first and second temperature sensors.

20. A fuel supply apparatus as claimed in claim 18, wherein said thermal insulator and means defining said intake air passage have a common spacing therebetween for further thermal insulation.

21. A method of controlling the air-fuel ratio of an air-fuel mixture supplied to an internal combustion engine comprising the steps of:

measuring the difference in temperature between the air drawn into the engine before admixture of fuel and the air-fuel mixture after admixture and vaporization of the fuel; and controlling the amount of fuel admixed into the air in accordance with the measured temperature difference, said controlling step including estimating the proportions of vaporized and unvaporized fuel in the air-fuel mixture and adjusting the amount of fuel in accordance with said estimate, and measuring engine speed and adjusting the amount of fuel in accordance with the measured engine speed.

22. A fuel supply apparatus as claimed in claim 1, wherein the engine operating condition is the engine speed.

23. A fuel supply apparatus as claimed in claim 1, wherein the engine operating condition is a parameter depending on the cross-sectional area of the intake air passage.

* * * * *